US007680248B2

(12) United States Patent
Matoba

(10) Patent No.: US 7,680,248 B2
(45) **Date of Patent: *Mar. 16, 2010**

(54) X-RAY TUBE AND X-RAY ANALYZING APPARATUS

(75) Inventor: Yoshiki Matoba, Chiba (JP)

(73) Assignee: SII NanoTechnology Inc., Chiba (JP)

( * ) Notice: Subject to any disclaimer, the term of this patent is extended or adjusted under 35 U.S.C. 154(b) by 93 days.

This patent is subject to a terminal disclaimer.

(21) Appl. No.: 11/972,352

(22) Filed: Jan. 10, 2008

(65) Prior Publication Data

US 2008/0181365 A1 Jul. 31, 2008

(30) Foreign Application Priority Data

Jan. 30, 2007 (JP) ..... 2007-018872
Jul. 28, 2007 (JP) ..... 2007-196818

(51) Int. Cl.
*H01J 5/18* (2006.01)

(52) U.S. Cl. ..... 378/140; 378/44

(58) Field of Classification Search ..... 378/44–49, 378/119–144

See application file for complete search history.

(56) References Cited

U.S. PATENT DOCUMENTS 6,005,918 A 12/1999 Harris et al. ..... 378/140
6,118,852 A 9/2000 Rogers et al. ..... 378/140
6,487,272 B1 11/2002 Kutsuzawa ..... 378/140
7,085,353 B2 8/2006 Yoshiyama et al. ..... 378/123
2009/0028297 A1* 1/2009 Matoba et al. ..... 378/140
2009/0041196 A1* 2/2009 Matoba et al. ..... 378/140

FOREIGN PATENT DOCUMENTS

JP 8-115694 A 5/1996
JP 3062685 B2 5/2000

* cited by examiner

*Primary Examiner*—Courtney Thomas
(74) *Attorney, Agent, or Firm*—Brinks Hofer Gilson & Lione

(57) ABSTRACT

To be able to achieve further small-sized formation and light-weighted formation and to promote a sensitivity by further efficiently detecting a fluorescent X-ray or the like in an X-ray tube and an X-ray analyzing apparatus, there are provided a vacuum cabinet 2 inside of which is brought into a vacuum state and which includes a window portion 1 formed by an X-ray transmitting film through which an X-ray can be transmitted, an electron beam source 3 installed at inside of the vacuum cabinet 2 for emitting an electron beam e, a target T generating a primary X-ray X1 by being irradiated with the electron beam e and installed at inside of the vacuum cabinet 2 to be able to emit the primary X-ray X1 to an outside sample S by way of the window portion 1, and an X-ray detecting element 4 arranged at inside of the vacuum cabinet 2 to be able to detect a fluorescent X-ray and a scattered X-ray X2 emitted from the sample S and incident from the window portion 1 for outputting a signal including energy information of the fluorescent X-ray and the scattered X-ray X2.

12 Claims, 4 Drawing Sheets

X-RAY TUBE AND X-RAY ANALYZING APPARATUS

This application claims priority under 35 U.S.C. § 119 to Japanese Patent Application Nos. JP2007-018872 filed Jan. 30, 2007 and JP2007-196818 filed Jul. 28, 2007, the entire content of which is hereby incorporated by reference.

BACKGROUND OF THE INVENTION

1. Field of the Invention

The present invention relates to an X-ray tube and an X-ray analyzing apparatus used for, for example, a fluorescent X-ray analyzing apparatus of an energy dispersion type and preferable for a small-sized and light-weighted handy type and portable type.

2. Description of the Related Art

Fluorescent X-ray analysis carries out a qualitative analysis or a quantitative analysis of a sample by irradiating primary X-ray emitted from an X-ray source to the sample and detecting fluorescent X-ray emitted from the sample by an X-ray detector to thereby acquire a spectrum from an energy of the fluorescent X-ray. The fluorescent X-ray analysis is widely used in step/quality control since the sample can be analyzed nondestructively and swiftly.

As analyzing methods of the fluorescent X-ray analysis, there are a wavelength dispersion type of measuring a wavelength and an intensity of an X-ray, an energy dispersion type of detecting the fluorescent X-ray by a semiconductor detecting element without dispersing the fluorescent X-ray and measuring an energy and an intensity of the X-ray by a pulse height analyzer.

In a related art, for example, Patent Reference 1 (JP-A-8-115694), in order to promote a sensitivity of fluorescent X-ray, a trial is carried out for making an X-ray tube and an X-ray analyzer proximate to a sample by providing the X-ray tube with a take out window for taking out fluorescent X-ray passing inside thereof to outside.

Further, as described in Patent Reference 2 (Japanese Patent No. 3062685), an energy dispersion type fluorescent X-ray analyzing apparatus of a handy type has been spread by small-sized formation of an X-ray tube and an X-ray analyzer.

According to the above-described related arts, the following problem remains.

For example, although according to the X-ray analyzing apparatus described in Patent Reference 1, there is achieved a significant effect promoting a detection sensitivity by making the X-ray tube and the X-ray detector proximate to the sample, the X-ray tube and the X-ray detector are respectively provided with limited and constant or more of sizes, and therefore, there is a limit in making the X-ray tube and the X-ray detector proximate to the sample.

Further, according to the handy type energy dispersion type fluorescent X-ray analyzing apparatus of the related art, although further small-sized formation and light-weighted formation are requested, as a constitution of the apparatus, the X-ray tube and the X-ray detector occupy most of a volume and a mass, and therefore, according to the related art, there is a limit in achieving further small-sized formation and light-weighted formation. Further, the handy type is constituted by an open type of irradiating primary X-ray directly to the sample in the atmosphere without containing the sample at inside of a sample chamber in a hermetically closed state to analyze, and therefore, in view of safety against X-ray, an amount of generating X-ray from the X-ray tube is restricted, and therefore, it is necessary to detect fluorescent X-ray from the sample further efficiently.

SUMMARY OF THE INVENTION

The invention has been carried out in view of the above-described problem and it is an object thereof to provide an X-ray tube and an X-ray analyzing apparatus capable of achieving further small-sized formation and light-weighted formation and capable of promoting a sensitivity by detecting a fluorescent X-ray or the like further efficiently.

The invention adopts the following constitution in order to resolve the above-described problem. That is, an X-ray tube of the invention comprises a vacuum cabinet inside of which is brought into a vacuum state and which includes a window portion formed by an X-ray transmitting film through which an X-ray can transmit, an electron beam source installed at inside of the vacuum cabinet for emitting an electron beam, a target for generating a primary X-ray by being irradiated with the electron beam and installed at inside of the vacuum cabinet to be able to emit the primary X-ray to an outside sample by way of the window portion, and an X-ray detecting element arranged at inside of the vacuum cabinet to be able to detect a fluorescent X-ray and a scattered X-ray emitted from the sample and incident from the window portion for outputting a signal including energy information of the fluorescent X-ray and the scattered X-ray.

According to the X-ray tube, the X-ray detecting element constituting an element of an X-ray detector is arranged at inside of the vacuum cabinet to be able to detect the fluorescent X-ray and the scattered X-ray incident from the window portion, and therefore, the X-ray detecting element is contained at inside of the vacuum cabinet integrally along with the electron beam source and the target constituting constituent elements of the X-ray tube to be able to further promote small-sized and light weight formation of a total of the apparatus. Further, the X-ray detecting element is arranged at inside of the vacuum cabinet to be proximate to the sample along with the target for generating the primary X-ray to be able to carry out detection, and therefore, excitation and detection can be carried out very efficiently. Further, when applied to a handy type of an open type, the efficient detection can be carried out, and therefore, the detection can be carried out with a high sensitivity even when an amount of generating the X-ray is further restrained and high safety can be achieved.

Further, according to the X-ray tube of the invention, the target is arranged to be proximate to or brought into contact with the window portion, and a light receiving face of the X-ray detecting element is arranged at a surrounding of the target.

That is, according to the X-ray tube, the light receiving face of the X-ray detecting element is arranged at the surrounding of the target, and therefore, when an analysis is carried out in a state of making the sample proximate to the window portion, the fluorescent X-ray or the like generated from the sample by the primary X-ray from the target can efficiently be detected by the X-ray detecting element arranged at the surrounding of the target (that is, a vicinity of the window portion).

Further, according to the X-ray tube of the invention, the X-ray detecting element includes a transmission hole which is arranged at a region between the electron beam source and the target and through which the electron beam can transmit. That is, according to the X-ray analyzing apparatus, the electron beam is irradiated through the transmission hole of the X-ray detecting element arranged between the electron beam source and the target, and therefore, the electron beam can be irradiated to the target by being narrowed by the transmission hole.

Further, according to the X-ray tube of the invention, at least one of the target and the window portion is set to a ground potential or a plus potential. That is, according to the X-ray tube, at least one of the target and the window portion is set to the ground potential or the plus potential, and therefore, the secondary electron can be restrained from being incident on the X-ray detecting element by pulling back the secondary electron from the target to the target or the window portion by an electric field.

Further, according to the X-ray tube of the invention, a shutter extractable and retractable to and from a path of the electron beam is provided between the electron beam source and the target. That is, according to the X-ray tube, the shutter extractable and retractable to and from the path of the electron beam is provided between the electron beam source and the target disposed at inside of the tube, and therefore, an X-ray generating point (target) and the sample can further be made to be proximate to each other more than a case of providing the shutter at a path of the primary X-ray. Further, a measurement can be carried out by the stabilized electron beam by bringing the shutter into the closed state until stabilizing the electron beam constituting a thermoelectron from the electron beam source and opening the shutter after stabilizing the electron beam.

Further, according to the X-ray tube of the invention, a shield member for shielding a radiation heat from the electron beam source is arranged between the electron beam source and the X-ray detecting element. That is, according to the X-ray tube, the shield member is provided between the electron beam source and the X-ray detecting element, and therefore, radiation heat from the electron beam source generating heat is shielded and an adverse influence by radiation heat on cooling the X-ray detecting element can be restrained.

An X-ray analyzing apparatus of the invention comprises the X-ray tube of the above-descried invention and an analyzer for analyzing the signal, and a display portion for displaying a result of analysis of the analyzer. That is, according to the X-ray analyzing apparatus, the X-ray tube of the invention is provided, and therefore, a total of the apparatus can be downsized.

Further, according to the X-ray analyzing apparatus of the invention, the analyzer and the display portion are provided in the vacuum cabinet to constitute a portable type. That is, according to the X-ray analyzing apparatus, the apparatus is constituted by the portable type integrally mounting the analyzer and the display portion to the vacuum cabinet, and therefore, the X-ray analyzing apparatus can be constituted by a handy type which can confirm a result of the analysis by the analyzer and the display portion on the cite and small-sized and light-weighted.

According to the invention, the following effect is achieved. That is, according to the X-ray tube and the X-ray analyzing apparatus of the invention, the X-ray detecting element is arranged at inside of the vacuum cabinet to be able to detect the fluorescent X-ray and the scattered X-ray incident from the window portion, and therefore, a total of the apparatus can further be small-sized and light-weighted and excitation and detection can further efficiently be carried out. Particularly, when the invention is applied to the X-ray analyzing apparatus of the handy type of the open type, an amount of generating the X-ray can be detected with high sensitivity even when the X-ray generating amount is further restrained and high safety can be achieved.

DESCRIPTION OF THE PREFERRED EMBODIMENTS

Embodiments of an X-ray tube and an X-ray analyzing apparatus according to the invention will be explained in reference to FIG. 1 and FIG. 2 as follows. Further, in the respective drawings used in the following explanation, contraction scale is pertinently changed in order to constitute respective members by sizes which are recognizable or easy to recognize.

Figure 1:
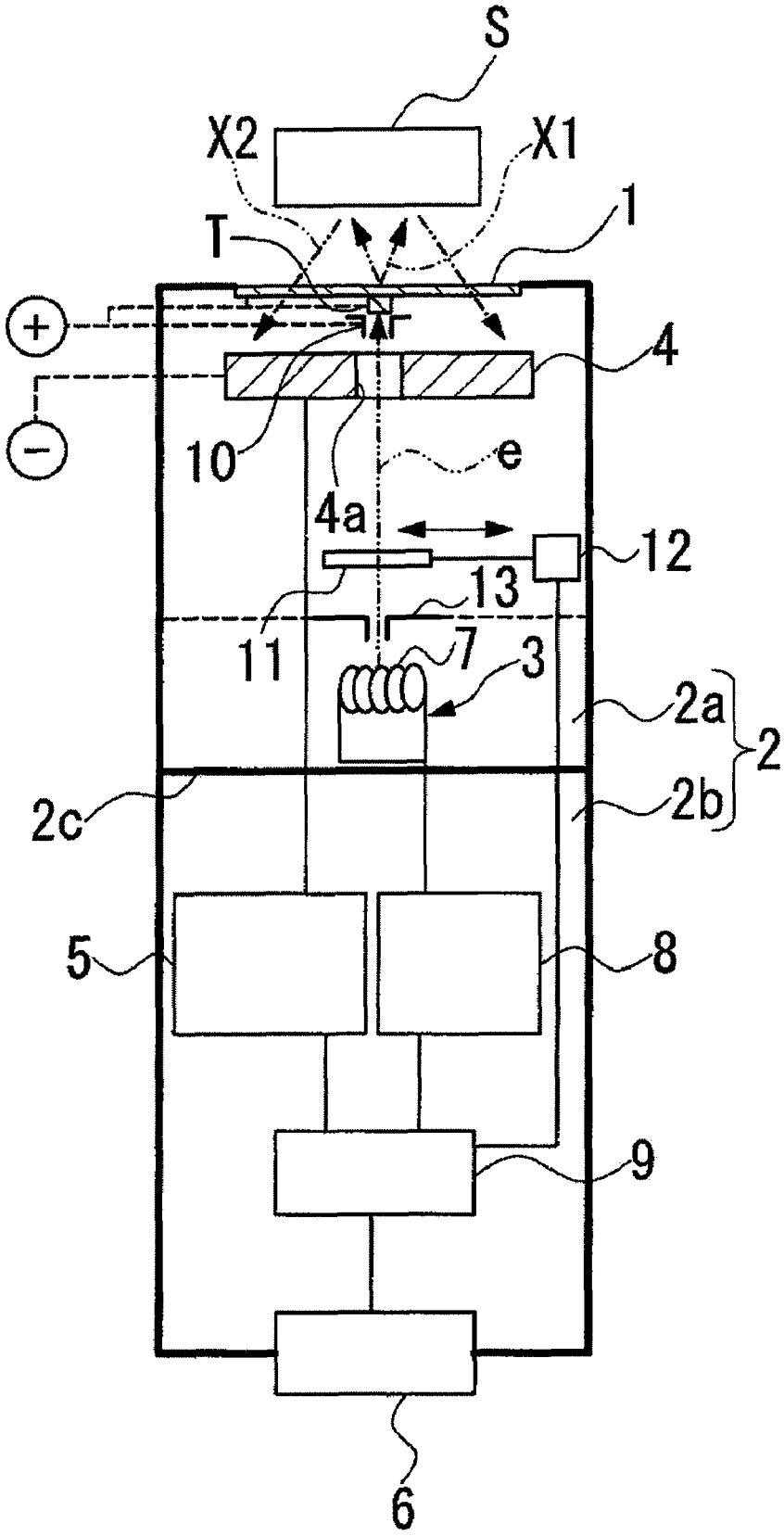
FIG. 1 is an outline total constitution view viewing an X-ray analyzing apparatus according to an embodiment of the X-ray analyzing apparatus according to the invention.

The X-ray analyzing apparatus of the embodiment is an energy dispersion type fluorescent X-ray analyzing apparatus of a portable type (handy type) and includes a vacuum cabinet 2 a portion of inside of which is brought into a vacuum state and which includes a window portion 1 formed by an X-ray transmitting film through which an X-ray can transmit, an electron beam source 3 installed at inside of the vacuum cabinet 2 for emitting an electron beam e, a target T which is irradiated with the electron beam e, generates a primary X-ray X1 and installed at inside of the vacuum cabinet 2 to be able to emit the primary X-ray X1 to a sample S at outside thereof by way of the window portion 1, an X-ray detecting element 4 which is arranged at inside of the vacuum cabinet 2 to be able to detect a fluorescent X-ray and a scattered X-ray X2 emitted from the sample S and incident from the window portion 1 for emitting a signal including energy information of the fluorescent X-ray and scattered X-ray X2, an analyzer 5 for analyzing the signal, and a display portion 6 for displaying a result of analysis of the analyzer 5 as shown by FIG. 1. Further, an X-ray tube is constituted by constructing a main constitution by the vacuum cabinet 2, the electron beam source 3, the target T and the X-ray detecting element 4.

The vacuum cabinet 2 is constituted by a front containing portion 2*a* inside of which is brought into a vacuum state, and a rear containing portion 2*b* which is partitioned from the front containing portion 2*a* by a partition wall 2*c* and inside of which is brought into an atmospheric pressure state.

The window portion 1 is formed by, for example, a Be (beryllium) foil as the X-ray transmitting film. Further, a front face of the window portion 1 may be attached with a primary filter constituting a metal thin film or a metal thin plate of Cu (cupper), Zr (zirconium), Mo or the like selected in accordance with the sample S. Further, the window portion 1 and the target T are set with a ground potential or a plus potential in order to pull back a secondary electron generated and discharged by an interactive operation of the electron beam e incident on the target T and the target T. Further, the secondary electron is normally provided with only an energy of about several eV, and therefore, the ground potential or the plus potential is set to constitute an electric field equal to or higher than the energy.

The electron beam source 3 includes a current/voltage control portion 8 for controlling a voltage between a filament 7 constituting a cathode and the target T constituting an anode (tube current) and a current of the electron beam e (tube current). The electron beam source 3 generates an X-ray generated by impacting a thermoelectron (electron beam) generated from the filament 7 constituting the cathode to the target T by being accelerated by a voltage applied between the filament 7 and the target T constituting the anode as primary X-ray.

Further, not the filament 7 but a carbon nanotube may be adopted for the cathode.

For example, W (tungsten), Mo (molybdenum), Cr (chromium), Rh (rhodium) or the like is adopted for the target T. The target T is arranged to be proximate to or brought into contact with the window portion 1. The X-ray detecting element 4 is a semiconductor detecting element of, for example, Si (silicon) element or the like constituting a pin structure diode. According to the X-ray detecting element 4, when one piece of an X-ray photon is incident thereon, a current pulse in correspondence with one piece of the X-ray photon is generated. An instantaneous current value of the current pulse is proportional to an energy of the incident fluorescent X-ray.

Figure 2:
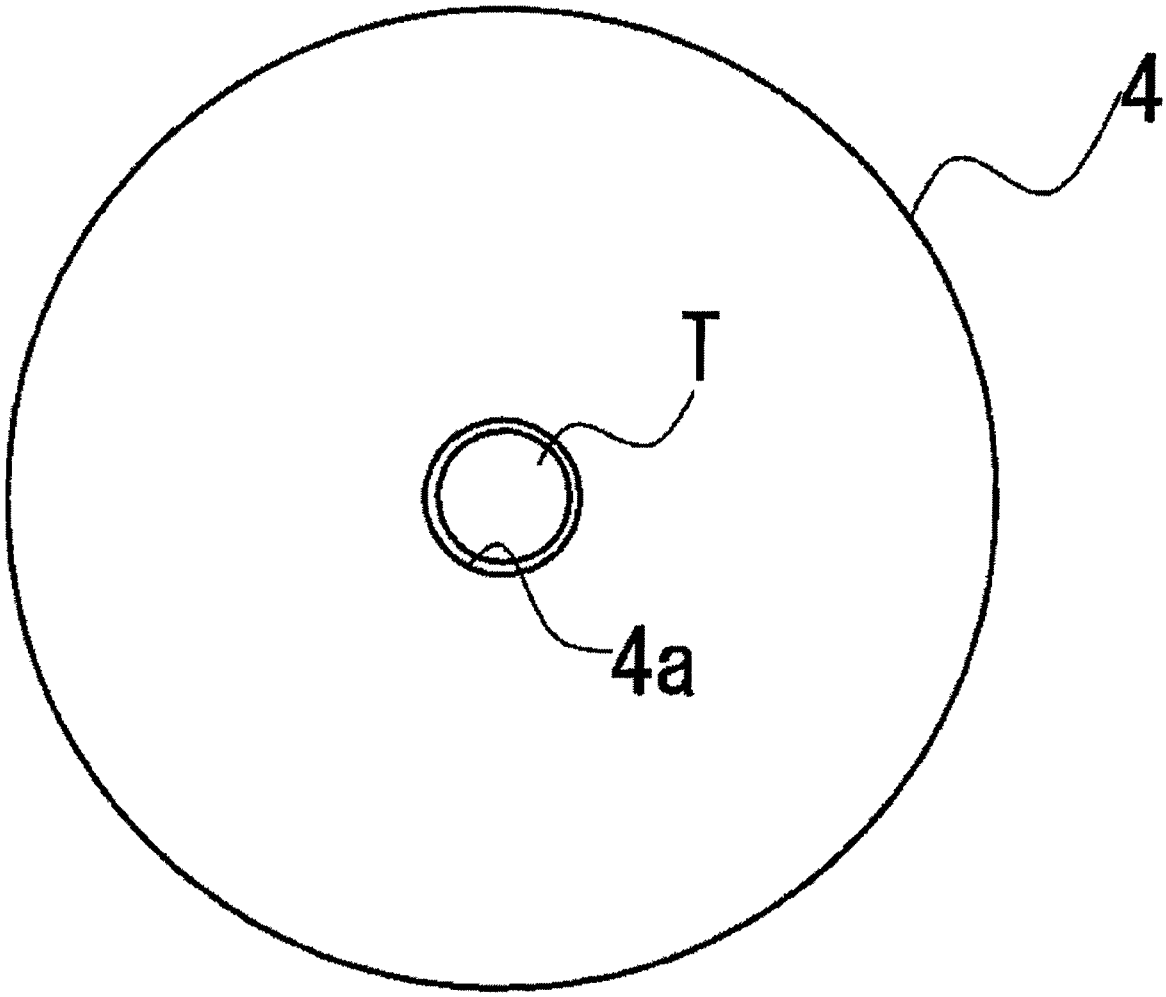
FIG. 2 is a front view of an essential portion showing a positional relationship between a target and an X-ray detecting element according to the embodiment.

As shown by FIG. 1 and FIG. 2, the X-ray detecting element 4 includes a transmission hole 4*a* arranged at a region between the filament 7 of the electron beam source 3 and the target T and capable of transmitting the electron beam e. Further, the target T is arranged right below and proximate to the transmission hole 4*a* and a light receiving face of the X-ray detecting element 4 is arranged at a surrounding of the target T.

Further, the X-ray detecting element 4 is set to be maintained at a constant temperature by a cooling mechanism, not illustrated, (for example, a cooling mechanism constituting a refrigerant by liquefied nitrogen or a cooling mechanism using a Peltier element). Further, the X-ray detecting element 4 can ensure an inherent function by being cooled to about −30 through −100°. Further, surrounding of the transmission hole 4*a* of the X-ray detecting element 4 is guarded by a metal plate or the like such that the primary X-ray X1 or the electron beam e is not incident on the light receiving face.

Further, a metal guard member 10 is provided between the target T and the X-ray detecting element 4 such that the primary X-ray X1, the secondary electron or a reflected electron from the target T is not brought into the X-ray detecting element 4. The metal guard member 10 is fixed to the vacuum cabinet 2 by a support member, not illustrated, and formed with a transmission hole of the electron beam e at a center thereof to be able to transmit the electron beam e. Further, the metal guard member 10 is set to a ground potential or a plus potential similar to the window portion 1 and the target T.

Further, by setting the X-ray detecting element 4 to a minus potential, it can be restrained that a thermoelectron (electron beam e) is incident on the X-ray detecting element 4.

Further, a shutter 11 is provided between the filament 7 of the electron beam source 3 and the target T to be extractable/retractable to and from a path of the electron beam e. The shutter 11 is formed by Ta, W, Cu or the like as a material capable of shielding the electron beam e and connected to a drive mechanism 12 of a small-sized motor, a solenoid or the like. The drive mechanism 12 is connected to CPU 9 and is controlled such that the shutter 11 is escaped from the path of the electron beam e and the electron beam e is irradiated to the target T only in measuring time. Further, CPU 9 carries out a control such that the shutter 11 is brought into a closed state until stabilizing the electron beam e constituting the thermoelectron from the filament 7 of the electron beam source 3 and the shutter 11 is opened after stabilizing the electron beam e.

Further, a shield member 13 having a hole for transmitting the electron beam e at a center thereof is arranged by being supported by the vacuum cabinet 2 between the electron beam source 3 and the X-ray detecting element 4. The shield member 13 is formed by a metal plate, a metal sheet or the like having a high thermal conductivity of Cu or the like for shielding radiation heat from the electron beam source 3 to escape heat to the vacuum cabinet 2 to thereby prevent an adverse influence from being effected on cooling the X-ray detecting element 4.

The filament 7, the target T, the X-ray detecting element 4, the metal guard member 10, the shutter 11, the drive mechanism 12 and the shield member 13 are arranged at inside of the front containing portion 2*a* of the vacuum cabinet 2.

The analyzer 5 is an X-ray signal processing portion and is a pulse height analyzer (multichannel pulse height analyzer) for converting and amplifying a current pulse generated at the X-ray detecting element 4 to a voltage pulse to constitute a signal and providing a pulse height of a voltage pulse from the signal to generate an energy spectrum.

Further, the current/voltage control portion 8 and the analyzer 5 are connected to CPU 9 to carry out various controls by the setting.

The display portion 6 is, for example, a liquid crystal display apparatus connected to CPU 9 to be able to display not only a result of analysis of the energy spectrum or the like but also various screens in accordance with the setting.

Further, the analyzer 5, the current/voltage control portion 8 and CPU 9 are provided at inside of the rear containing portion 2*b* of the vacuum cabinet 2 and the display portion 6 is provided by arranging a display face thereof at an outer face of the rear containing portion 2*b*. That is, the analyzer 5 and the display portion 6 are integrally provided to the vacuum cabinet 2.

Further, the above-described respective constitutions which need to be supplied with power and set with potential are connected to a power source portion, not illustrated.

In this way, according to the embodiment, the X-ray detecting element 4 is arranged at inside of the vacuum cabinet 2 to be able to detect the fluorescent X-ray and the scattered X-ray X2 incident from the window portion 1, and therefore, the X-ray detecting element 4 is integrally contained at inside of the vacuum cabinet 2 along with the electron beam source 3 and the target T and a total of the apparatus can further be small-sized and light-weighted. Further, the X-ray detecting element 4 is arranged at inside of the vacuum cabinet 2 and can carry out the detection by being proximate to the sample S along with the target T for generating the primary X-ray X1, and therefore, excitation and detection can be carried out very efficiently. Particularly, the efficient detection can be carried out by being applied to a handy type of the open type, and therefore, the detection can be carried out with a high sensitivity even by further restraining an amount of generating the X-ray and high safety can be achieved.

Further, the light receiving face of the X-ray detecting element 4 is arranged at the surrounding of the target T, and therefore, when an analysis is carried out in a state of making the sample S proximate to the window portion 1, the fluorescent X-ray or the like generated from the sample S by the primary X-ray X1 from the target T can be detected efficiently by the X-ray detecting element 4 arranged at the surrounding of the target T (that is, a vicinity of the window portion 1).

Further, the electron beam e is irradiated to the target by way of the transmission hole 4*a* of the X-ray detecting element 4 arranged between the electron beam source 3 and the target T, and therefore, the electron beam e can be irradiated to the target T by being narrowed by the transmission hole 4*a*.

Further, the metal guard member 10 is provided between the X-ray detecting element 4 and the target T, and therefore, the secondary electron generated at the target T is shielded and is prevented from being incident on the X-ray detecting element 4. Further, the metal guard member 10 shields radiation heat from a peripheral portion of the target and can restrain an adverse influence from being effected on cooling the X-ray detecting element 4.

Further, the metal guard member 10 is set to the ground potential or the plus potential, and therefore, a high shield effect can be achieved by pulling the secondary electron from the target T to the metal guard member 10 by the electric field.

Further, the target T and the window portion 1 are set to the ground potential or the plus potential, and therefore, the secondary electron can be restrained from being incident on the X-ray detecting element 4 by pulling back the secondary electron from the target T to the target T and the window portion 1 by the electric field.

Further, the shutter 11 extractable/retractable to and from the path of the electron beam e is provided between the filament 7 and the target T disposed at inside of the tube, and therefore, an X-ray generating point (target T) and the sample S can be made to be proximate to each other more than a case of providing the shutter at a path of the primary X-ray. Further, the shutter 11 is brought into the closed state until stabilizing the electron beam e constituting the thermoelectron from the filament 7 and the shutter 11 is opened after stabilizing the electron beam e, and therefore, measurement can be carried out by the stabilized electron beam e.

Further, the invention is constituted by the portable type integrally mounting the analyzer 5 and the display portion 6 to the vacuum cabinet 2, and therefore, the invention can be constituted by the handy type which can confirm the result of analysis by the analyzer 5 and the display portion 6 on the cite and small-sized and light-weighted.

Further, the technical range of the invention is not limited to the above-described embodiment but can variously be modified within the range not deviated from the gist of the invention.

Figure 3:
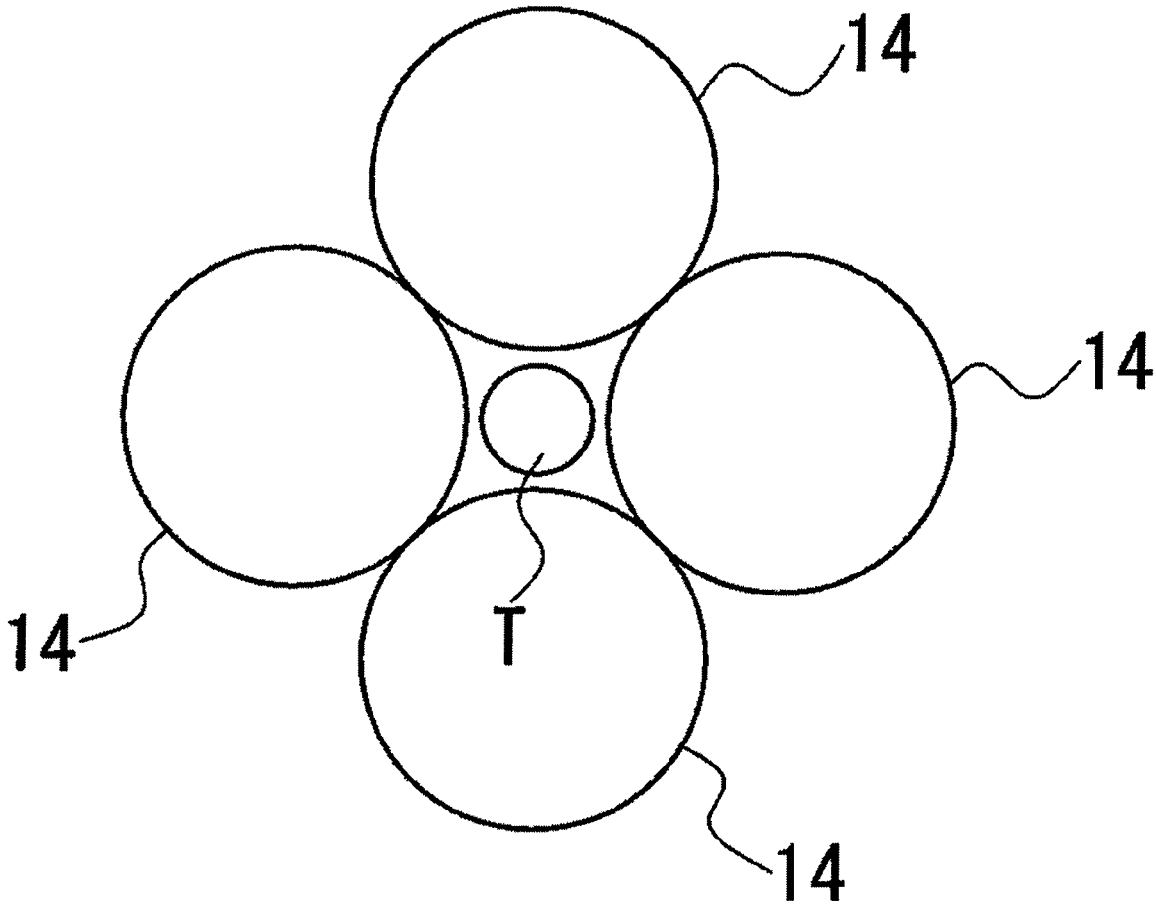
FIG. 3 is a front view of an essential portion showing a positional relationship between a target and an X-ray detecting element according to other example 1 of the embodiment.
Figure 4:
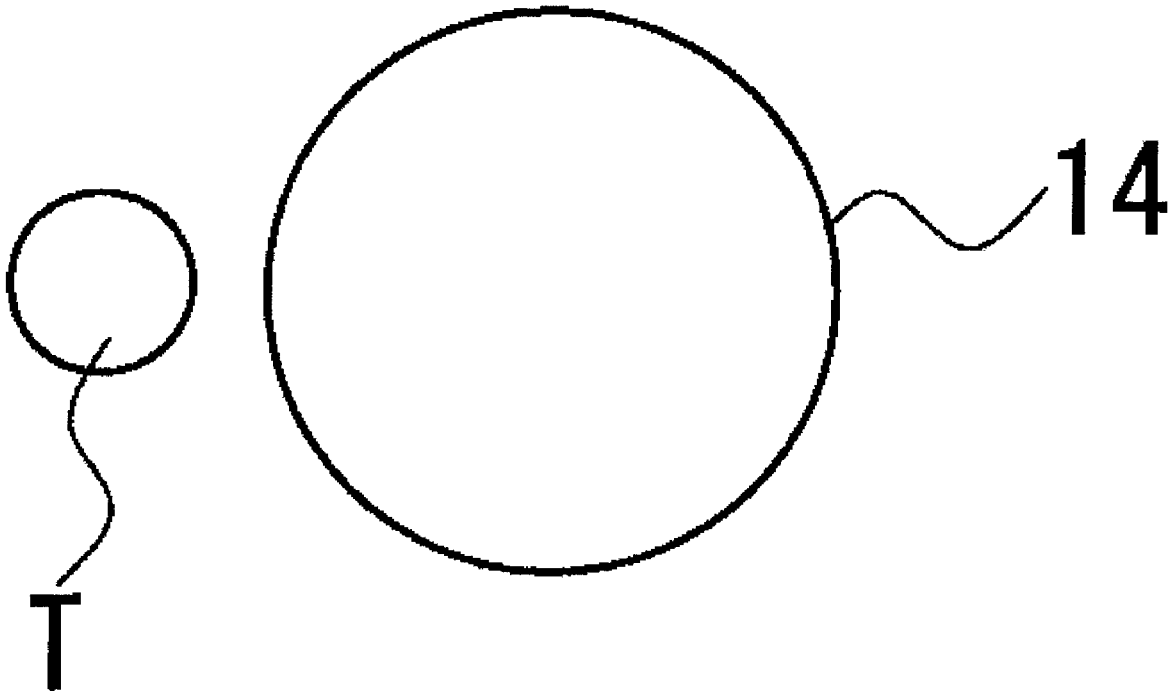
FIG. 4 is a front view of an essential portion showing a positional relationship between a target and an X-ray detecting element according to other example 2 of the embodiment.

For example, although according to the above-described embodiment, the single X-ray detecting element 4 formed with the transmission hole 4*a* at the center is used, as other example 1, as shown by FIG. 3, there may be constructed a constitution in which a plurality of X-ray detecting elements 14 are arranged at the surrounding of the target T. Further, as other example 2, as shown by FIG. 4, there may be constructed a constitution in which only one of the X-ray detecting element 14 is arranged at the surrounding of the target T.

Further, although the above-described embodiment is the energy dispersion type fluorescent X-ray analyzing apparatus, the invention may be applied to other type of analysis, for example, a wavelength dispersion type fluorescent X-ray analyzing apparatus.

Further, the invention may be constituted by a so-to-speak reflection type for generating a primary X-ray by irradiating an electron beam to a target in a column-like shape from a filament in a shape of a circular ring arranged at a surrounding thereof as in the X-ray tube described in Patent Reference 1.

Further, although the invention is preferable for the handy type X-ray analyzing apparatus as in the above-described embodiment, the invention may be applied to an X-ray analyzing apparatus of a stationary type. For example, there may be constituted a stationary type X-ray analyzing apparatus constituted by separately providing an X-ray tube constituted by, for example, the vacuum cabinet 2, the electron beam source 3, the target T and the X-ray detecting element 4, and the analyzer 5, a control system and the display portion 6 or the like.

What is claimed is:

1. An X-ray tube comprising:

a vacuum cabinet inside of which is brought into a vacuum state and which includes a window portion formed by an X-ray transmitting film through which an X-ray is transmitted;

an electron beam source installed at inside of the vacuum cabinet for emitting an electron beam;

a target for generating a primary X-ray by being irradiated with the electron beam and installed at inside of the vacuum cabinet to be able to emit the primary X-ray to an outside sample by way of the window portion, wherein at least one of the target and the window portion is set to a ground potential or a plus potential; and an X-ray detecting element arranged at inside of the vacuum cabinet for detecting a fluorescent X-ray and a scattered X-ray emitted from the sample and incident from the window portion for outputting a signal including energy information of the fluorescent X-ray and the scattered X-ray.

2. The X-ray tube according to claim 1, wherein the target is arranged proximate to or brought into contact with the window portion; and wherein a light receiving face of the X-ray detecting element is arranged at a surrounding of the target.

3. The X-ray tube according to claim 1, wherein the X-ray detecting element includes a transmission hole which is arranged at a region between the electron beam source and the target and through which the electron beam is transmitted.

4. The X-ray tube according to claim 1, wherein a shutter extractable and retractable to and from a path of the electron beam is provided between the electron beam source and the target.

5. The X-ray tube according to claim 1, wherein a shield member for shielding a radiation heat from the electron beam source is arranged between the electron beam source and the X-ray detecting element.

6. An X-ray analyzing apparatus comprising:

a X-ray tube comprising:

a vacuum cabinet inside of which is brought into a vacuum state and which includes a window portion formed by an X-ray transmitting film through which an X-ray is transmitted;

an electron beam source installed at inside of the vacuum cabinet for emitting an electron beam;

a target for generating a primary X-ray by being irradiated with the electron beam and installed at inside of the vacuum cabinet to be able to emit the primary X-ray to an outside sample by way of the window portion; and an X-ray detecting element arranged at inside of the vacuum cabinet for detecting a fluorescent X-ray and a scattered X-ray emitted from the sample and incident from the window portion for outputting a signal including energy information of the fluorescent X-ray and the scattered X-ray;

an analyzer for analyzing the signal; and a display portion for displaying a result of analysis of the analyzer.

7. The X-ray analyzing apparatus according to claim 6, wherein the analyzer and the display portion are provided in the vacuum cabinet to constitute a portable type.

8. An X-ray tube comprising:

a vacuum cabinet inside of which is brought into a vacuum state and which includes a window portion formed by an X-ray transmitting film through which an X-ray is transmitted;

an electron beam source installed at inside of the vacuum cabinet for emitting an electron beam;

a target for generating a primary X-ray by being irradiated with the electron beam and installed at inside of the vacuum cabinet to be able to emit the primary X-ray to an outside sample by way of the window portion; and an X-ray detecting element arranged at inside of the vacuum cabinet for detecting a fluorescent X-ray and a scattered X-ray emitted from the sample and incident from the window portion for outputting a signal including energy information of the fluorescent X-ray and the scattered X-ray, wherein the X-ray detecting element comprises a transmission hole which is arranged at a region between the electron beam source and the target and through which the electron beam is transmitted.

9. The X-ray tube according to claim 8, wherein the target is arranged proximate to or brought into contact with the window portion; and wherein a light receiving face of the X-ray detecting element is arranged at a surrounding of the target.

10. The X-ray tube according to claim 8, wherein at least one of the target and the window portion is set to a ground potential or a plus potential.

11. The X-ray tube according to claim 8, wherein a shutter extractable and retractable to and from a path of the electron beam is provided between the electron beam source and the target.

12. The X-ray tube according to claim 8, wherein a shield member for shielding a radiation heat from the electron beam source is arranged between the electron beam source and the X-ray detecting element.

* * * * *